US007370816B2

(12) United States Patent
Kumagai et al.

(10) Patent No.: US 7,370,816 B2
(45) Date of Patent: May 13, 2008

(54) FUEL INJECTOR

(75) Inventors: Masato Kumagai, Saitama (JP); Hiroshi Yamada, Gunma (JP); Satoshi Hashimoto, Gunma (JP); Nobuaki Kobayashi, Gunma (JP)

(73) Assignee: Hitachi, Ltd., Tokyo (JP)

( * ) Notice: Subject to any disclaimer, the term of this patent is extended or adjusted under 35 U.S.C. 154(b) by 20 days.

(21) Appl. No.: 11/585,847

(22) Filed: Oct. 25, 2006

(65) Prior Publication Data

US 2007/0095949 A1 May 3, 2007

(30) Foreign Application Priority Data

Oct. 28, 2005 (JP) ..... 2005-315172
Aug. 11, 2006 (JP) ..... 2006-219631

(51) Int. Cl.
*F02M 61/00* (2006.01)
*F02M 59/00* (2006.01)

(52) U.S. Cl. ..... 239/533.12; 239/585.1; 239/533.2

(58) Field of Classification Search ..... 239/533.2, 239/533.12, 533.14, 585.1
See application file for complete search history.

(56) References Cited

U.S. PATENT DOCUMENTS 5,193,747 A * 3/1993 Preussner ..... 239/288.5
5,823,444 A * 10/1998 Reiter et al. ..... 239/533.12
5,984,211 A * 11/1999 Sugimoto et al. ..... 239/596
6,131,826 A * 10/2000 Teiwes ..... 239/533.11
7,017,839 B2 * 3/2006 Heyse ..... 239/533.12
7,066,408 B2 * 6/2006 Sugimoto et al. ..... 239/461
7,093,776 B2 * 8/2006 Schneider ..... 239/533.12
2002/0092930 A1 * 7/2002 Itatsu ..... 239/533.3
2003/0164412 A1 * 9/2003 Iwase ..... 239/533.12
2003/0222159 A1 * 12/2003 Kobayashi et al. .... 239/533.12
2005/0067507 A1 * 3/2005 Tomiita ..... 239/533.12
2006/0191511 A1 * 8/2006 Mifuji et al. ..... 123/305

FOREIGN PATENT DOCUMENTS

JP 3-130571 A 6/1991
JP 3-108855 U 11/1991
JP 2005-155547 A 6/2005

* cited by examiner

*Primary Examiner*—Thomas Moulis
(74) *Attorney, Agent, or Firm*—Antonelli, Terry, Stout & Kraus, LLP.

(57) ABSTRACT

A fuel injector includes a tube member and a valve element to slide axially in the tube member. The valve element includes a center portion and a plurality of plate portions projecting radially from the center portion, and each including side surfaces extending axially; and a guide section including an outer portion defining a valve seat, and an inner portion which is located on a radial inner side of the outer portion, and which is formed with at least one injection hole. The guide section is arranged to divert the flow of the fuel conveyed along the plate portions, to a radial inward direction toward the injection hole.

18 Claims, 8 Drawing Sheets

| | COMPARATIVE | EMBODIMENT | EMBODIMENT |
|---|---|---|---|
| NUMBER OF PLATE PORTIONS | 0 | 3 | 6 |
| FORWARD END PORTION |   |   |   |
| CROSS SECTION |   |   |   |

FUEL INJECTOR

BACKGROUND OF THE INVENTION

The present invention relates to a fuel injector or fuel injection valve.

A fuel injector of one known type includes a valve seat member formed with a valve seat; a valve element slidably received in a tube member and driven by a drive section to move to and from the valve seat; and a nozzle plate formed with one or more injection holes to inject fuel after passage through the interspace opened between the valve element and valve seat in a valve open state. Fuel injectors of such a type are disclosed in Published Japanese Patent Application Publication No. H03-130571published on Jun. 4, 1991; Published Japanese Utility Model Application Publication No. H03-108855published on Nov. 8, 1991; and Published Japanese Patent Application Publication No. 2005-155547 published on Jun. 16, 2005. Fuel supplied into the tube member is conveyed through a hollow portion between the inside circumferential surface of the tube member and the valve element, thereafter guided to the nozzle plate and injected through the injection holes. In the fuel injector of Published Japanese Patent Application Publication No. 2005-155547, the valve element includes a spherical valve body and a sliding portion slidably supported by the tube member.

SUMMARY OF THE INVENTION

In a fuel injector of such a type, the sliding portion of the valve element tends to disturb the flow of fuel during the flow between the side surface of the valve element and the inside circumferential surface of the tube member, and thereby to exert adverse influence on the atomization of injected fuel.

It is therefore an object of the present invention to provide a fuel injector to promote the atomization of injected fuel.

According to one aspect of the present invention, a fuel injector comprises: a tube member including an inside bore for passage of a fuel; a valve seat provided in a downstream end portion of the tube member; a valve element arranged to slide axially in the tube member to and away from the valve seat; a plurality of plate portions provided in the valve element and arranged to slide on an inside circumference surface of the tube member, the plate portions projecting radially with respect to an axis of the tube member, each of the plate portions including a side surface extending along the axis of the tube member; a drive section to move the valve element to and away from the valve seat; a nozzle member including at least one injection hole located on an inner side of the valve seat within the tube member and arranged to inject the fuel allowed to pass through a clearance formed between the valve element and the valve seat; and a guide portion to bend the flow of the fuel allowed to flow along the plate portions, toward the axis of the tube member and thereby to guide the fuel to the injection hole.

According to another aspect of the invention, a fuel injector comprises: a tube member including an inside bore for passage of a fuel; a valve element arranged to slide axially in the tube member between a valve close position, and a valve open position, the valve element including a center portion; and a plurality of plate portions projecting radially from the center portion and fitting slidably in the tube member(; and a guide section including an outer portion defining a valve seat provided at a downstream end of the tube member, and an inner portion which is located on a radial inner side of the outer portion, and which is formed with at least one injection hole arranged to inject the fuel conveyed through an interspace formed between the valve seat and the valve element, the guide section being arranged to divert the flow of the fuel conveyed along the plate portions, to a radial inward direction toward the injection hole.

DETAILED DESCRIPTION OF THE INVENTION

Figure 1:
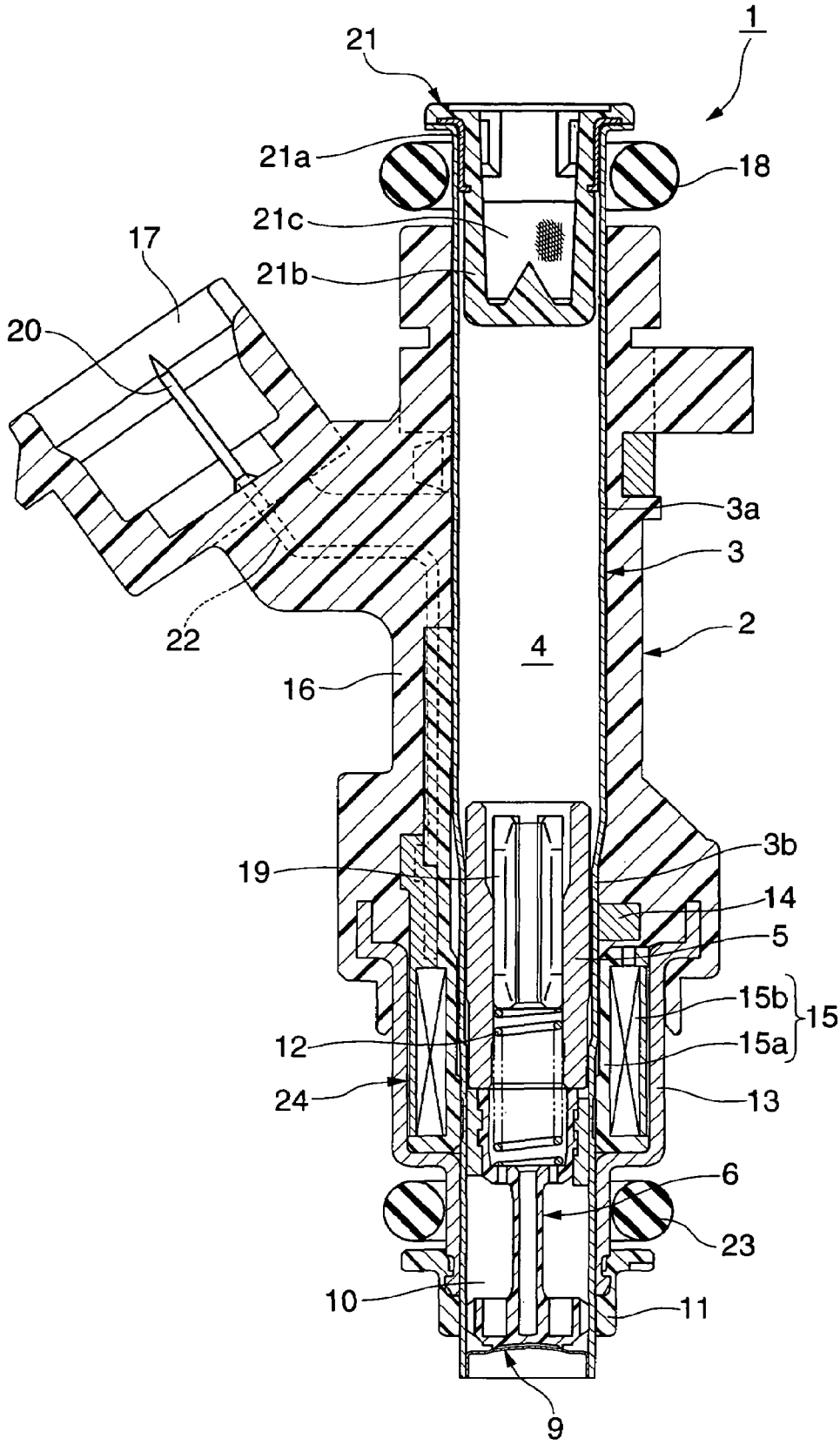
FIG. 1 is a sectional view of a fuel injector according to a first embodiment of the present invention.
Figure 2:
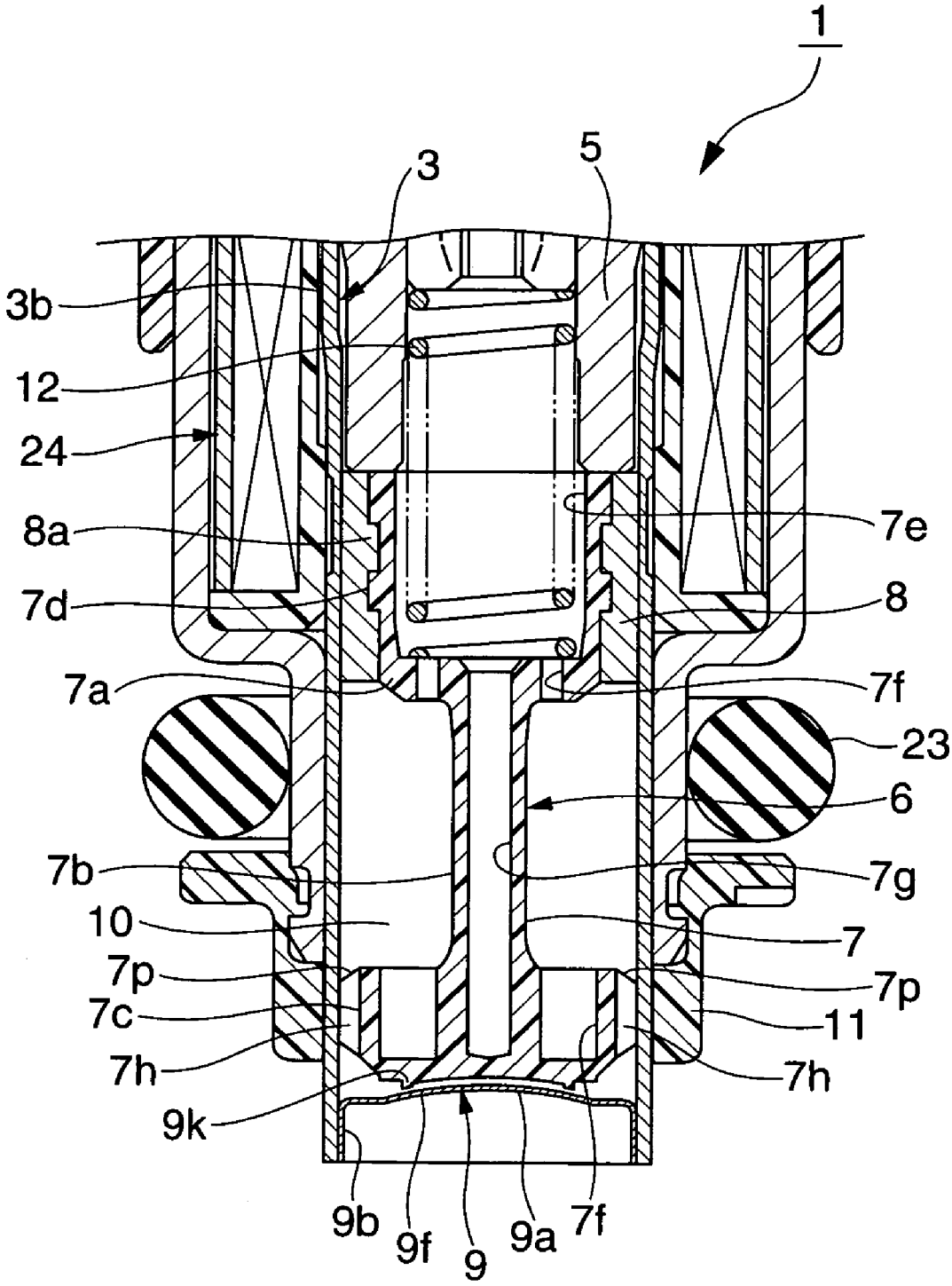
FIG. 2 is an enlarged sectional view showing a downstream end portion of the fuel injector of FIG. 1.
Figure 3A:
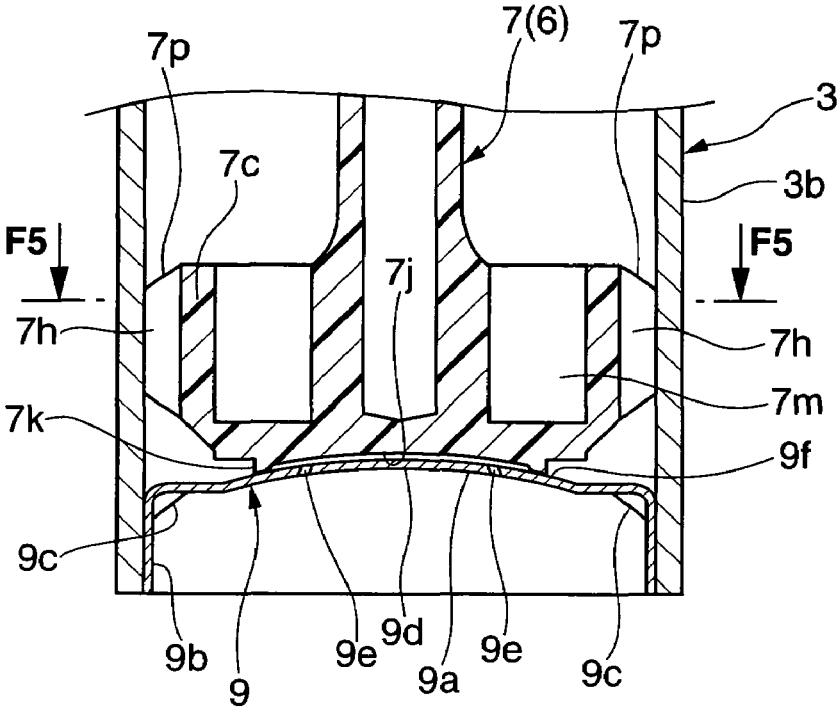
FIGS. 3A and 3B are enlarged sectional views showing the downstream end portion of the fuel injector of FIG. 1 in a seated state (valve close state) and an unseated state (valve open state), respectively.
Figure 3B:
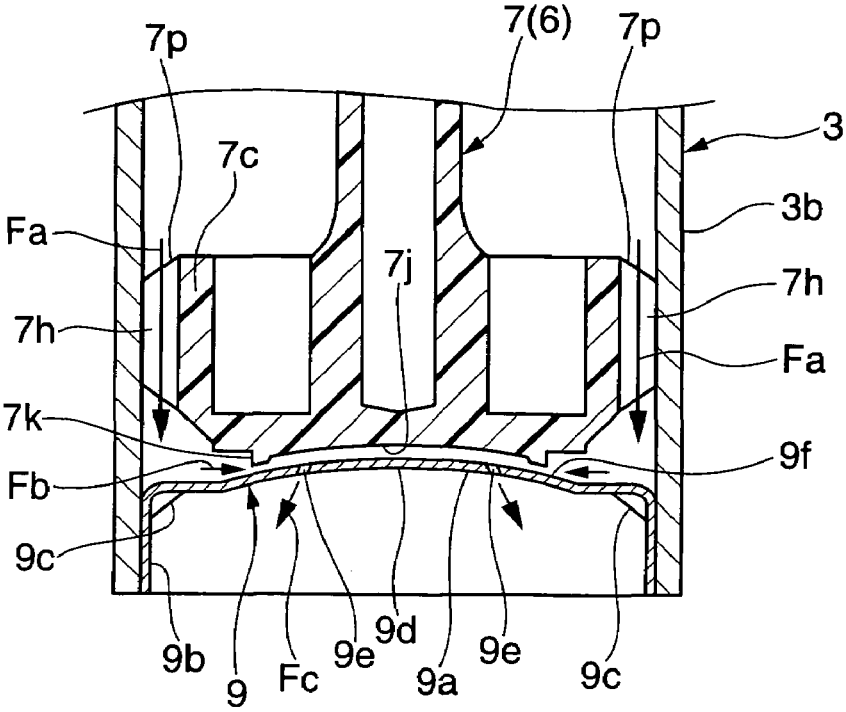
Figure 4:
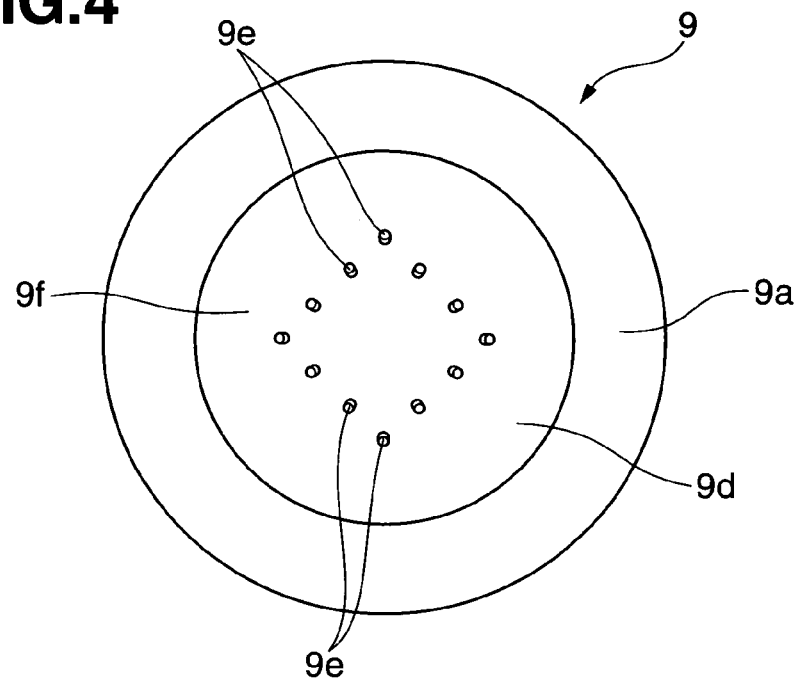
FIG. 4 is a plan view of a nozzle member in the fuel injector of FIG. 1.
Figure 5:
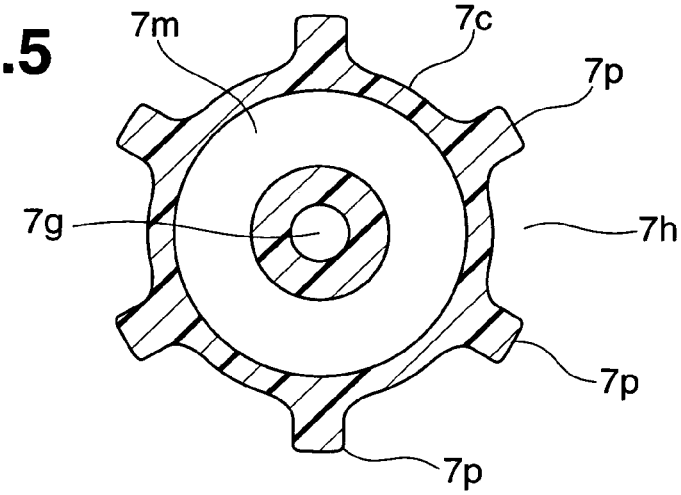
FIG. 5 is a cross sectional view of the valve element taken across a line F5-F5 in FIG. 3A.

A first embodiment of the present invention is illustrated in FIGS. 1~5. In the first embodiment, the present invention is applied to a fuel injector or fuel injection valve for an internal combustion engine. FIG. 1 is a longitudinal sectional view showing a fuel injector according to the first embodiment as if cut by a plane extending along an axis of the fuel injector. FIG. 2 is an enlarged sectional view showing a portion around a valve element of the fuel injector of FIG. 1. FIGS. 3A and 3B are enlarged sectional views showing a downstream end portion of the fuel injector of FIG. 1 in a seated state (valve close state) and an unseated state (valve open state), respectively. FIG. 4 is a plan view showing a nozzle member of the fuel injector of FIG. 1. FIG. 5 is a sectional view of the valve element across a line F5-F5 shown in FIG. 3A.

A fuel injector 1 shown in FIG. 1 is adapted to be connected with a boss portion of a fuel pipe, and to inject fuel supplied through the fuel pipe, into an internal combustion engine (into an intake port or directly into a cylinder).

As shown in FIG. 1, fuel injector 1 includes a main body which includes a casing 2, a tube member 3, a core tube 5, a yoke 13 and a resin cover 16.

The tube member 3 is a stepped thin-wall metal tube of a magnetic material such as stainless material or stainless alloy, formed by press forming such as deep drawing. Tube member 3 of this example extends axially from a first end (upper end or upstream end) to a second end (lower end or downstream end), and includes a large diameter section 3*a* extending from the first end toward the second end and a small diameter section 3*b* extending from the second end to a step formed between the large and small diameter sections 3*a* and 3*b*. The first (upstream) end of tube member 3 is adapted to be inserted in a boss portion of a fuel pipe and thereby connected with the fuel pipe.

An O-ring 18 is fit over the outside circumference of the first end of tube member 3 to secure a liquid-tight connection between tube member 3 and the boss portion of the fuel pipe. A filter 21 is fit in the upstream end of tube member 3. Filter 21 includes a tubular portion 21*a* press-fit in the large diameter section of tube member 3; a frame portion 21*b* of a resin material (such as nylon or fluoroplastics) softer than the material of tube member 3, formed integrally with the tubular portion 21*a* (by injection molding, in this example); and a mesh element 21*c*installed in frame portion 21*b* and arranged to allow the fuel to pass through.

Inside the tube member 3, there are provided the core tube 5; a valve element 6 on the downstream side of core tube 5; and a nozzle member 9 on the downstream side of valve element 6. Nozzle member 9 is a single integral (jointless) member. Valve element 6 is slidable axially between the core tube 5 and nozzle member 9 which are fixed in tube member 3.

Core tube 5 is a member to form a closed magnetic circuit with an outer tube portion 8 of valve element 6 and yoke 13, and to define a valve open position of valve element 6 by limiting the axial movement of valve element 6. Core tube 5 is installed in the small diameter section 3*b* of tube member 3 by press fitting.

Nozzle member 9 is located in a downstream end portion of tube member 3 so as to close the downstream end of tube member 3. As shown in FIGS. 2~4, nozzle member 9 is a cup-shaped member including an end portion 9*a* and a tubular portion 9*b*. In this example, the end portion 9*a* is a circular-disk-shaped end portion closing the downstream end of tube member 3 and confronting a valve portion 7 of valve element 6 axially; and the tubular portion 9*b* is a cylindrical portion 9*b* extending axially from the circumference of the end portion 9*a* toward the downstream end of tube member 3. Inside the nozzle member 9, ribs 9*c* are formed between the disk-shaped end portion 9*a* and cylindrical portion 9*b*. Nozzle member 9 is press fit in tube member 3, and the outside cylindrical surface of cylindrical portion 9*b* is tightly fit in the inside cylindrical surface of tube member 3. The disk-shaped end portion 9*a* is in the form of a thin plate which, in this example, has a wall thickness smaller than the wall thickness of tubular member 3.

The disk-shaped end portion 9*a* of nozzle member 9 includes an inner portion formed with a plurality of injection holes 9*e*; an outer portion surrounding the inner portion and defining a valve seat 9*f*; and an outermost guide portion surrounding the valve seat 9*f* of the outer portion. In this example, the inner portion formed with injection holes 9*e* is a center portion, the outer portion of the valve seat 9*f* is an annular portion surrounding the inner portion including injection holes 9*e*, and the outermost guide portion is an annular portion surrounding the outer portion of the valve seat 9*f*. In this example, the inner and outer portions are inner and outer regions of a domed portion 9*d* bulging upward toward valve element 6 on the upstream side. The outermost guide portion is an annular flat portion which surrounds the domed portion 9*d* and which is shaped like a circular ring bounded between two concentric circles, as shown in FIG. 4.

Each of injection holes 9*e* is a through hole passing through the wall of disk-shaped end portion 9*a*. In this example, each injection hole 9*e* is slightly inclined so as to inject fuel in a direction slightly inclined toward the radial outward side with respect to the axial direction. In this example, each injection hole 9*e* is tapered. For example, each injection hole 9*e* is tapered in the downstream direction so that the diameter or cross sectional size of the injection hole 9*e* becomes gradually smaller from the upstream open end of the injection hole to the downstream open end. Alternatively, each injection hole 9*e* may be tapered in the upstream direction or flared in the downstream direction so that the diameter or cross sectional size of the injection hole 9*e* becomes gradually greater from the upstream open end of the injection hole to the downstream open end.

The annular outer portion of disk-shaped end portion 9*a* of nozzle member 9 has an upstream surface facing toward valve element 6 and serving as the annular valve seat 9*f* on which valve portion 7 of valve element 6 rests when closed. The annular valve seat 9*f* of the annular outer portion surrounds all the injection holes 9*e*formed in the central inner portion which is located on the radial inner side of the annular valve seat 9*f* of the outer portion. Preferably, the outer portion 9*f* defining the valve seat is thicker than the inner portion formed with the injection holes, so that the wall thickness of the outer portion is greater than the wall thickness of the inner portion.

The nozzle member 9 serves as a guide section for guiding the flow of the fuel to injection holes 9*e* by bending the flow direction of the fuel from the axial flow along plate portions 7*p* of valve element 6, to the radial inward direction toward the center axis of tube member 3.

The valve element 6 is received slidably in small diameter section 3*b* of tube member 3, and arranged to move axially between core tube 5 and nozzle member 9, toward and away from the valve seat 9*f* of nozzle member 9. In this embodiment, valve element 6 includes an outer tube portion 8 of a magnetic metallic material in the form of a tube extending axially; and a valve portion 7 which is made of a resin, which is fixed in the outer portion 8, and which is arranged to rest on the valve seat 9*f* and to rise from valve seat 9*f*. In this example, the outer tube portion 8 and valve portion 7 are joined together by an interdigitating structure of an outside portion 7*d* formed in the outside wall surface of valve portion 7 and composes of a projection and a depression, and an inside portion 8*d*formed in the inside wall surface of outer tube portion 8 and composed of a projection fit in the depression of the outside portion 7*d*, and a depression fitting over the projection of the outside portion 7*d* of valve portion 7. This interdigitating structure can be formed by insert molding.

As shown in FIGS. 2 and 3, the valve portion 7 includes an upstream enlarged portion 7*a* fit fixedly in the outer tube portion 8; a downstream enlarged portion 7*c*; and an intermediate narrow portion 7*b* having a cross sectional size smaller than each of the enlarge portions 7*a* and 7*c*, extending downstream from the upstream enlarged portion 7*a* to the downstream enlarged portion 7*c* and thereby connecting the upstream and downstream portions 7*a* and 7*c*. A fuel chamber 10 is formed around the intermediate narrow portion 7*b* within the tube member 3.

Upstream enlarge portion 7*a* of valve portion 7 is cup-shaped, and includes a cylindrical wall opening upstream and a bottom closing a downstream end of the cylindrical wall. Upstream enlarge portion 7*a* includes an inside cavity 7*e* defined by the cylindrical wall and the bottom, and arranged to receive a part of a coil spring 12. A plurality of through holes 7*f* are formed in the bottom of upstream enlarge portion 7*a*. These through holes 7*f*fluidly connect the inside cavity 7*e* of upstream enlarged portion 7*a* to fuel chamber 10 formed around the intermediate narrow portion 7*b*. A blind hole 7*g* is formed in valve portion 7 to reduce the weight and improve the formability of valve element 6. The blind hole 7*g* extends along the center line of valve element 6 from the bottom of upstream enlarged portion 7*a*, through intermediate narrow portion 7*b* to downstream enlarged portion 7*c*.

The downstream enlarged portion 7*c* includes a center portion and a plurality of plate portions 7*p* projecting radially outwards from the center portion, and defining a plurality of fuel passages 7*h* in the form of guide grooves for conducing the fuel from fuel chamber 10 toward the nozzle member 9. Preferably, fuel passages 7*h* are formed at regular angular intervals or with a predetermined pitch in the outer circumference of downstream enlarged portion 7*c*. Each fuel passage 7*h* is formed between adjacent two of the plate portions 7*p* and the inside circumferential (cylindrical) wall surface of tube member 3. In this embodiment, as shown in FIG. 5, the center portion of downstream enlarged portion 7*c* includes a cylindrical wall, and six of the plate portions 7*p* projects from the cylindrical wall in a manner of radial symmetry, to respective projecting ends adapted to slide on the inside circumferential wall surface of tube member 3. Each plate portion 7*p* has two side surfaces extending straight along the axis of tube member 3, and thereby regulating the fuel flow to straighten the flow along the axial direction of tube member 3 toward the downstream end. Plate portion 7*h* slide on the inside circumferential surface of tube member 3 when valve element 6 moves axially in tube member 3.

In the illustrated example, the six plate portions 7*p* are arranged at regular angular intervals of 60 degrees.

The bottom of downstream enlarged portion 7*c* of valve portion 7 (that is, the forward end portion of the valve element) is formed with a spherical depression 7*j* depressed approximately in conformity with the dome shape of the domed portion 9*d* of nozzle member 9, around the center axis of the valve element 6. The bending radius of this spherical depression 7*j* is smaller than the bending radius of domed portion 9*d*. An annular abutting projection 7*k* is formed so as to fringe the outer circumference of the spherical depression 7*j*, and adapted to abut fittingly on the annular valve seat 9*f* of nozzle member 9. In the valve close state shown in FIG. 3A, the annular abutting projection 7*k* of valve element 6 abuts tightly on the annular valve seat 9*f*. In the valve open state shown in FIG. 3B, the annular abutting projection 7*k* of valve element 6 is spaced apart from the valve seat 7*f*. In this structure, the domed portion 9*d* of nozzle member 9 serves as a receiving portion to receive the forward end portion of the valve element, and thereby functions to guide the spherical depression 7*j* and align the valve element 6 with the center axis of the domed portion of nozzle member 9. Therefore, the valve element 6 can be centered correctly on nozzle member 9 when valve element 6 is seated on the valve seat. In this example, the downstream enlarged portion 7*c* is formed with an annular blind hole 7*m* to reduce the weight and improve the formability.

Valve element 6 of this example is slidably supported, at both of the upstream end portion and the downstream end portion, in the small diameter section 3*b* of tube member 3. That is, the outer tube portion 8 of valve element 6 is slidably fit in the small diameter portion 3*b* of tube member 3, and at the same time the radially arranged plate portions 7*p* of downstream enlarged portion 7*c* are slidably fit in the small diameter portion 3*b* of tube member 3. Thus, valve element 6 is supported at two separate positions of valve element, in tube member 3 so that valve element 6 can slide axially in (the small diameter portion 3*b* of) tube member 3.

A drive section 24 shown in FIGS. 1 and 2 is arranged to drive the valve element 6 to move axially toward and away from the valve seat 9*f*. Drive section 24 of this example includes at least a coil spring 12 serving as a biasing means, and a magnetic coil 15.

The upper end of coil spring 12 abuts against the lower end of a tubular adjuster 19 fit in core tube 5. The lower end of coil spring 12 is received in the inside cavity 7*e* of valve element 6. Coil spring 12 is thus disposed under compression, as a compression spring, between the core tube 5 and valve element 6, so as to urge the valve element 6 in a valve closing direction away from core tube 5, toward the valve seat 9*f*.

The yoke 13 is a stepped tubular member mounted on tube member 3. In this example, yoke 13 is forcibly fit over the small diameter portion 3*b* of tube member 3, and thereby fixedly mounted on the small diameter portion 3*b*. A connection core 14 is provided between yoke 13 and the small diameter portion 3*b* of tube member 3. In this example, connection core 14 is an approximately C-shaped magnetic member surrounding the small diameter portion 3*b* of tube member 3. A resin cap 11 is fixed to a lower end portion of yoke 13, and arranged to define a groove for receiving an O-ring 23.

The magnetic coil 15 is disposed between the yoke 13 and tube member 3. Magnetic coil 15 includes a tubular bobbin 15*a* of resin material mounted on the small diameter portion 3*a* of tube member 3; and a wire 15*b* wound around bobbin 15*a*. Magnetic coil 15 is energized through at least one pin 20 of a connector 17, and conductor 22 formed in a resin cover 16.

The resin cover 16 encloses the tube member 3. Resin cover 16 of this example is formed by an injection molding in the state of a subassembly of tube member 3 including yoke 13, connecting core 14 and magnetic coil 15 mounted on tube member 3. Connector 17 and resin cover 16 are integral parts of a single resin molding.

The thus-constructed fuel injector is held, by the urging force of coil spring 12, normally in the close state shown in FIG. 3A when the magnetic coil 15 is not energized. In the close state, the valve element 6 is seated on valve seat 9*f*, and the annular abutting portion 7*k* of valve element 6 abuts on the annular valve seat 9*f* so that the injection holes 9*e* are closed as a whole.

When magnetic coil 15 is energized, the core tube 5, outer tube portion 8 of valve element 6 and yoke 13 form a closed magnetic circuit producing, in the outer tube portion 8, a magnetic force toward the core tube 5. Since the setting is such that the magnetic force (attraction force) becomes greater than the urging force of coil spring 15, the valve element 6 is attracted by the magnetic force against the urging force of coil spring 15, toward the core tube 5 away from the valve seat 9*f*, and the fuel injector is brought to the valve open state of FIG. 3B in which the abutting portion 7*k* of valve element 6 is spaced apart from the valve seat 9*f* so as to open the injection holes 9*e*.

In this open state, the fuel flows down the fuel passage 4 in tube member 3 and core tube 5, and flows into fuel chamber 10 through the inside cavities of adjuster 19 and core tube 5, the depressed portion 7*e* and the through holes 7*f* of valve element 6. From fuel chamber 10, the fuel flows through the fuel passages 7*h* formed around the downstream enlarged portion 7*c* of valve element 6, and the gap or clearance formed between the abutting portion 7*k* of valve element 6 and valve seat 9*f*, and gushes out of injection holes 9*e*.

In this fuel injector, the fuel flow F*a* in each fuel passage 7*h* is regulated in the axial direction by the axially extending plate portions 7*p* serving as means for regulating a fluid flow. Then, the flow is bent largely so as to form an approximately right angle or a sharp angle from the axial direction of the flow F*a* to the radial direction of fuel flow F*b* through the clearance between the abutting portion 7*k* and the valve seat 9*f*, by the guide of nozzle member 9 serving as guide section. Thereafter, the direction of fuel flow is changed again largely from the fuel flow F*b* to a fuel flow F*c* through each injection hole 9*e*, sharply so as to form an approximately right angle or a sharp angle. By changing the flow direction in this way, the fuel injector can cause separation of fuel from a wall surface and turbulent flow; thereby produce disturbance in the fuel flow injected from each injection hole 9*e*; and consequently promote the agitation with air and atomization of the fuel spray.

With the plate portions 7*p* and nozzle member 9 serving as the guide section, the thus-constructed fuel injector according to the first embodiment can change the direction of the fuel flow flowing from the plate portions 7*p*, to the valve seat 9*f* sharply, and thereby promote the atomization of injected fuel by causing separation of fuel from a wall surface, and turbulent flow.

In the first embodiment, the injection holes 9*e*and valve seat 9*f* are both formed in the nozzle member 9. This structure can decrease the number of required parts; facilitate the assembly process; and hence reduce the production cost of the fuel injector by decreasing the cost of component parts and the cost of the production process, as compared to the conventional structure having a member for defining a valve seat and a distinct member formed with injection holes.

As compared to the conventional structure having a member defining a valve seat and a distinct member formed with one or more injection holes, the single nozzle member 9 including both the valve seat 9*f* and one or more injection holes 9*e* makes it possible to decrease the size of the forward end portion of the fuel injector, and hence increase the degree of freedom in the layout of a mounting portion of the fuel injector in an internal combustion engine.

In this embodiment, the injection holes 9*e* are opened in the disk-shaped end portion 9*a* of nozzle member 9. Therefore, it is easy to adjust the direction of fuel flow toward the injection holes 9*e* by adjusting the shape of disk-shaped end portion 9*a*, and thereby to promote the atomization of fuel.

In the nozzle member 9 according to this embodiment, the outer portion in which valve seat 9*f* is formed is thicker in wall thickness than the inner portion in which one or more injection holes 9*e* are formed. Therefore, the rigidity of valve seat 9*f* is increased, and the durability of the fuel injector is improved.

In this embodiment, each of the injection holes 9*e* is tapered. Therefore, when fuel is injected through the injection hole 9*e*, the tapered injection hole tends to cause the fuel to form a liquid film on a circumferential surface of the injection hole 9*e*, and thereby promote the atomization.

In this embodiment, tube member 3 supports the valve element 6 slidably at the upstream and downstream end portions spaced along the axis of tube member 3. This structure is effective to prevent inclination of the valve element 6 and to improve the assembly accuracy of valve element 6, as compared to the structure in which the valve element is slidably supported at one end portion.

In this embodiment, the plate portions 7*p* are arranged radially at regular intervals around the center axis of tube member 3. This arrangement is effective to prevent inclination of the valve element 6, and to improve the accuracy in assemblage of valve element 6.

In this embodiment, with the upstream and downstream end portions being both slidably fit in tube member 3, the valve element 6 can slide in tube member 3 smoothly, and increase the dynamic flow rate. In the case of the support structure in which the upstream and downstream end portion of the valve elements are supported, respectively, by two different members, it is necessary to increase the accuracy in shape of the two members, and the accuracy in position of the two members in order to ensure the smooth movement of the valve member. By contrast to this, in the support structure according to this embodiment, it suffices to improve the accuracy in shape of tube member 3.

In this embodiment, the domed portion 9*d* of nozzle member 9 can improve the rigidity of nozzle member 9 and thereby improve the durability of nozzle member 9 against the fuel pressure and load applied from valve element 6, as compared to a nozzle member having an entirely flat end portion. Furthermore, one or more ribs 9*c* can further improve the rigidity and durability of nozzle member 9.

In this embodiment, the fuel injector has a self aligning or centering structure formed by the domed portion 9*d* of nozzle member 9 and the mating spherical depression 7*j* of valve element 6, to align the valve element 6 with the center axis of valve seat 9*f* when valve element 6 is seated on valve seat 9*f*. By preventing positional deviation between valve element 6 and nozzle member 9, this structure can ensure the sealing between valve element 6 and nozzle member 9, and reliably prevent leakage of fuel in the valve close state.

In this embodiment, the valve element 6 includes the valve portion 7 made of resin material. Therefore, the valve element 6 is lighter in weight as compared to a valve element made entirely of metallic material, and advantageous to lower the sound pressure level of noise produced by the abutment of the valve element on the valve seat.

As a variation of this embodiment, it is optional to form the fuel passages 7*h* in a helical shape so as to produce swirling flow.

Figure 6:
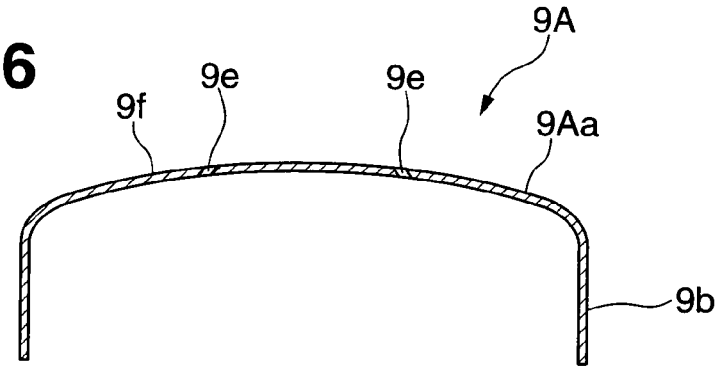
FIG. 6 is a sectional view of a nozzle member of a fuel injector according to a second embodiment of the present invention.

A second embodiment of the present invention is illustrated in FIG. 6. FIG. 6 is a sectional view of a nozzle member 9A of a fuel injector according to the second embodiment. Except for the nozzle member, the fuel injector according to the second embodiment is substantially identical to the fuel injector shown in FIG. 1 according to the first embodiment. Accordingly, the same reference numerals are employed for the corresponding members and repetitive explanation is omitted.

The nozzle member 9A is a cup-shaped single member including a circular-disk-shaped end portion 9Aa and a cylindrical portion 9*b* extending axially from the circumference of end portion 9Aa like the nozzle member 9 according to the first embodiment. Unlike nozzle member 9, however, the end portion 9Aa is bulged entirely toward valve element 6, and shaped entirely in the form of a dome. Cylindrical portion 9*b* extends axially from the rim of the dome-shaped end portion 9Aa. In the example shown in FIG. 6, nozzle member 9A has no ribs (9*c*).

The dome-shaped end portion 9Aa functions to increase the rigidity of nozzle member 9A, and thereby to improve the durability of nozzle member 9A to bear the fuel pressure and load applied from valve element 6.

Figure 7:
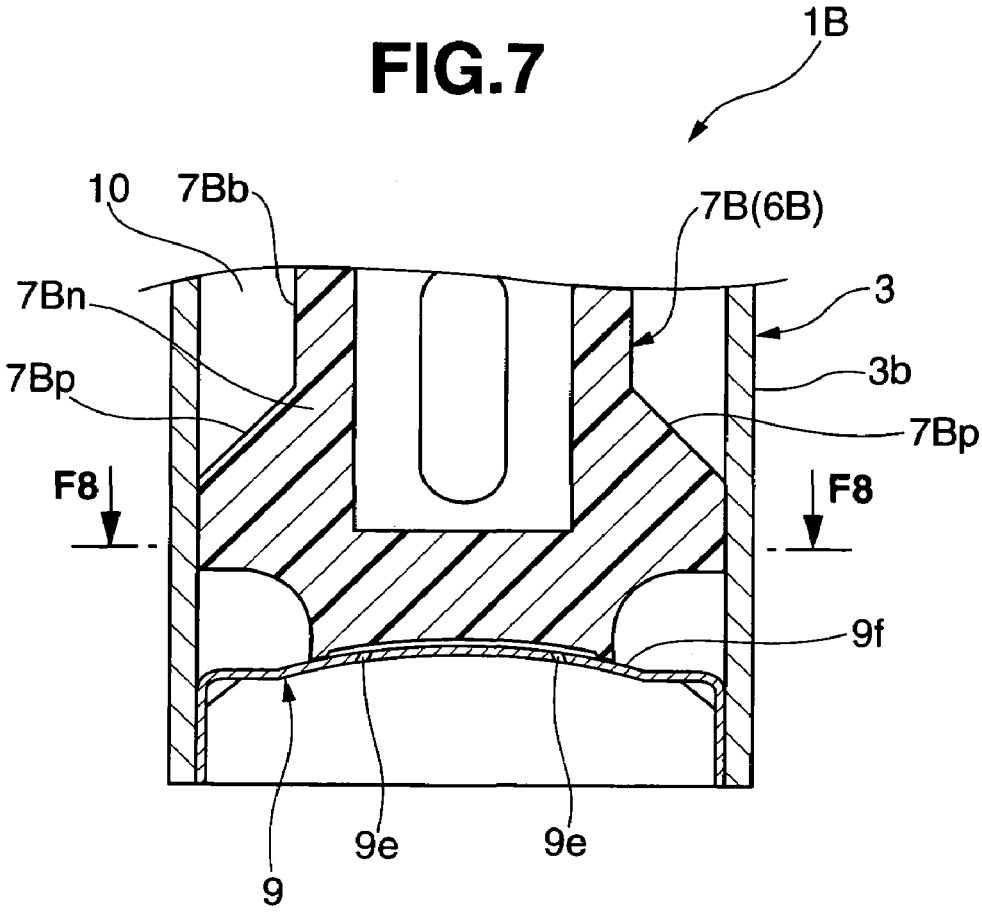
FIG. 7 is an enlarged sectional view showing a downstream end portion of a fuel injector according to a third embodiment of the present invention.
Figure 8:
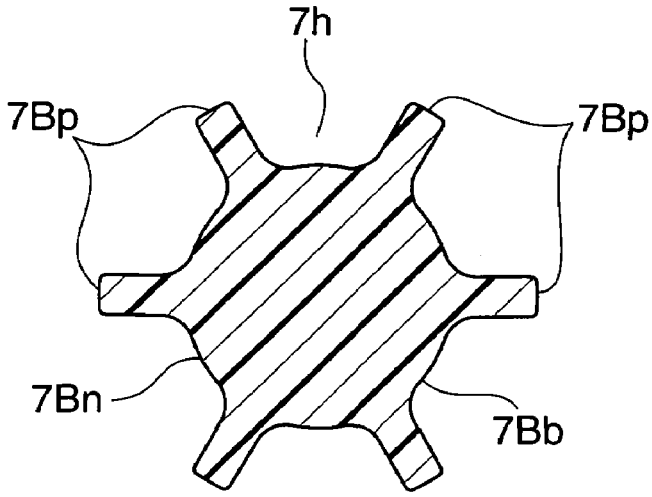
FIG. 8 is a cross sectional view of a valve element taken across a line F8-F8 in FIG. 7.

A third embodiment is illustrated in FIGS. 7~10. FIG. 7 is an enlarged sectional view showing a downstream end portion of a fuel injector 1B including a valve element 6B according to the third embodiment. FIG. 8 is a cross sectional view of the valve element taken across a line F8-F8 shown in FIG. 7. The fuel injector according to the third embodiment is almost identical to the fuel injector shown in FIG. 1. Accordingly, the same reference numerals are employed for the corresponding members and repetitive explanation is omitted. The third embodiment is applicable to the fuel injector according to the first embodiment and to the fuel injector according to the second embodiment. In the example shown in FIG. 7, the third embodiment is applied to the first embodiment.

The fuel injector 1B according to the third embodiment is different, in the shape of the valve element 6B, from the valve element 6 of the preceding embodiments. A valve portion 7B of valve element 6B includes a downstream end portion which includes a cylindrical center portion 7Bn and a plurality of plate portions 7Bp. Cylindrical center portion 7Bn extends in the axial direction of tube member 3 in alignment with the intermediate portion 7Bb of the valve portion 7*b* of valve element 6, and has a diameter substantially equal to the diameter of intermediate portion 7Bb. Plate portions 7Bp project radially from the cylindrical center portion 7Bn, and define a plurality of groove-shaped fuel passages 7*h*, each between two adjacent plate portions 7Bp.

Plate portions 7Bp project from the cylindrical center portion 7Bn radially in the manner of radial symmetry, to respective projecting ends adapted to slide on the inside circumferential (cylindrical) wall surface of the small diameter portion 3*b* of tube member 3. Each plate portion 7Bp has side surfaces extending axially in the axial direction of tube member 3.

With the plate portions 7Bp, the fuel injector according to the third embodiment can change the direction of the fuel flow from the plate portions 7Bp toward valve seat 9*f* as in the first embodiment largely, and thereby promote the atomization of injected fuel by separation of fuel from a wall surface and turbulence flow.

Figure 9:
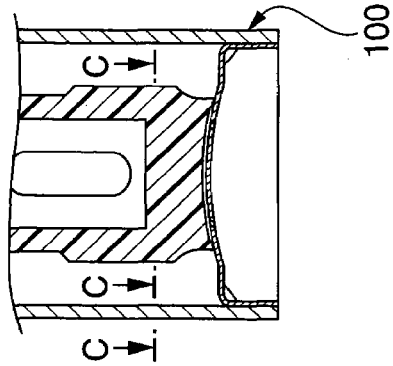
FIG. 9 is a view for explaining experiment performed to confirm the influence on the atomization of injected fuel, of the position of plate portions in the fuel injector according to the third embodiment.
Figure 9:
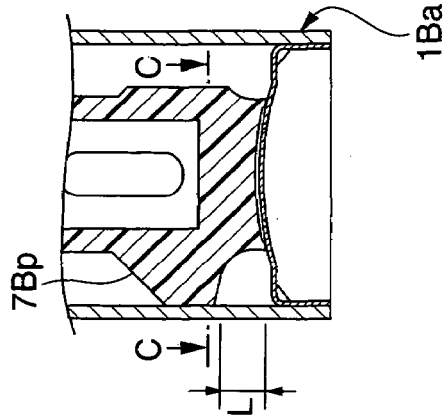
Figure 9:
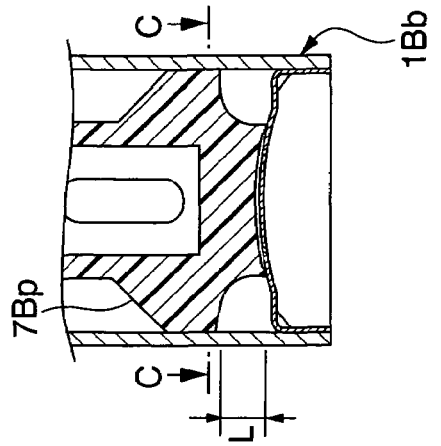
Figure 9:
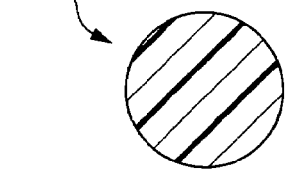
Figure 9:
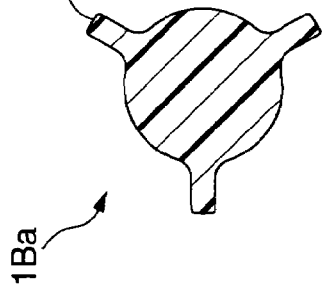
Figure 9:
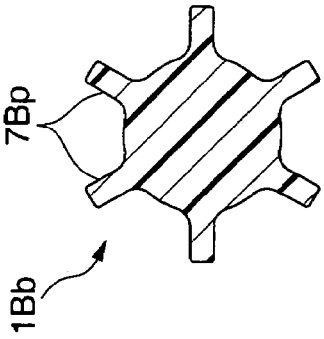
Figure 10:
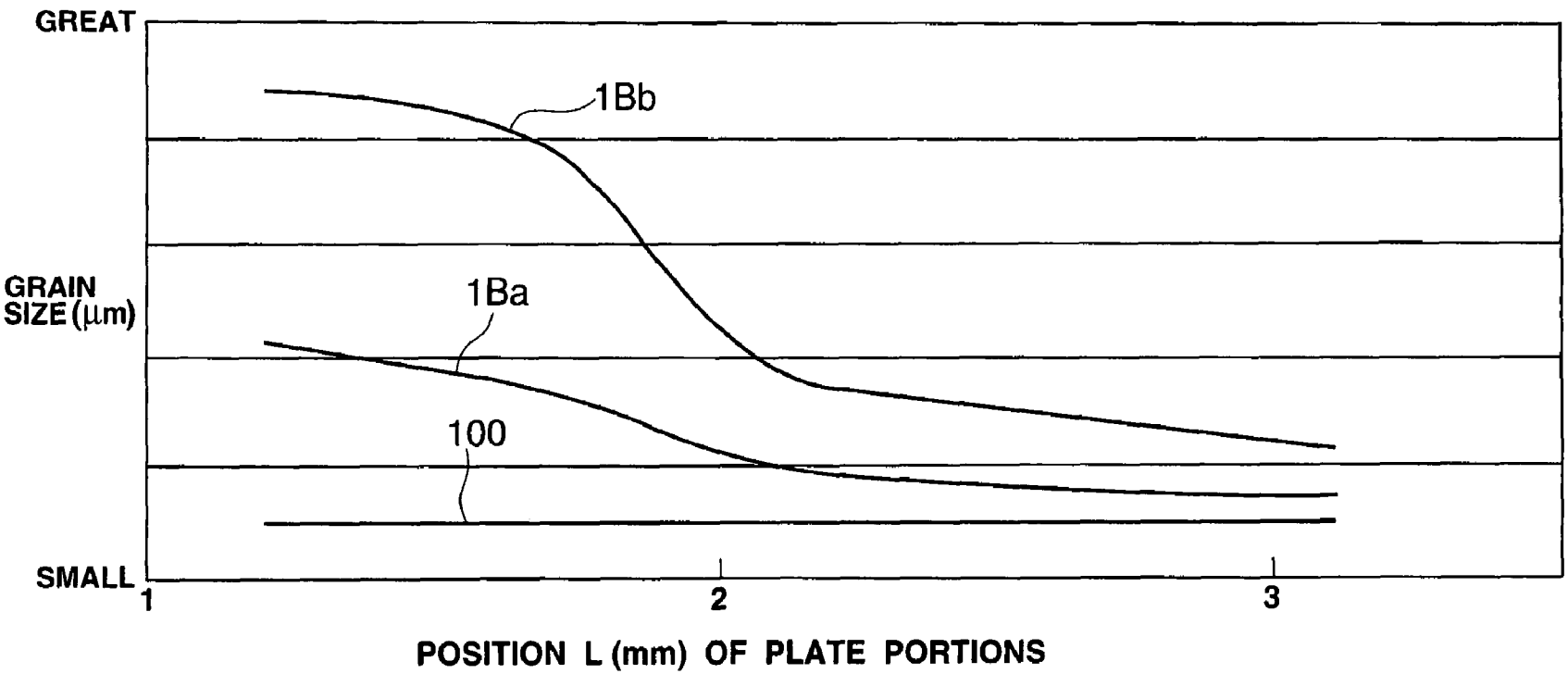
FIG. 10 is a graph showing the result of the experiment illustrated in FIG. 9.

FIGS. 9 and 10 show the result of experiment performed to confirm the influence of the position of plate portions 7Bp on fuel atomization. FIG. 9 is a view to illustrate the experiment; and FIG. 10 is a graph showing the result of the experiment.

As shown in FIG. 9, the experiment was performed by injecting fuel and measuring the particle diameter or grain size of injected fuel, by the use of a first type fuel injector 1B (referred to as fuel injector 1Ba) having three plate portions 7Bp arranged at regular intervals (of 120°), and a second type fuel injector 1B (referred to as fuel injector 1Bb) having six plate portions 7Bp arranged at regular intervals (of 60°), with the distance L from the forward end of valve element 6B in the axial direction of tube member 3 being set equal to 1.1 mm, 1.6 mm, 2.1 mm and 3.1 mm. Similarly, the experiment was performed by injecting fuel and measuring the particle size by the use of a fuel injector 100 having no plate portions 7Bp, as a comparative example.

As shown in FIG. 10, the fuel grain size was decreased with increase in the axial distance L from the forward end of valve element 6B to the plate portions 7Bp. In FIG. 10, a curve 1Ba shows the characteristic of the fuel injector 1Ba; a curve 1Bb shows the characteristic of fuel injector 1Bb; and a curve 100 shows the characteristic of fuel injector 100 of the comparative example.

Figure 11:
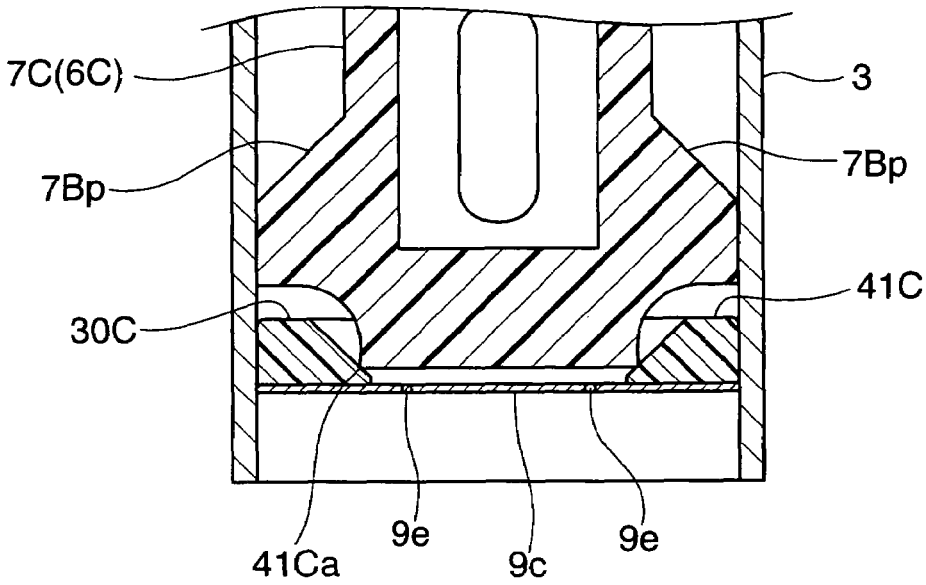
FIG. 11 is an enlarged sectional view showing a downstream end portion of a fuel injector according to a fourth embodiment of the present invention.

A fourth embodiment of the present invention is illustrated in FIG. 11. FIG. 11 is an enlarged sectional view showing a downstream end portion of a fuel injector according to the fourth embodiment. The fuel injector according to the fourth embodiment is almost identical to the fuel injectors according to the preceding embodiments. Accordingly, the same reference numerals are employed for the corresponding parts and repetitive explanation is omitted. The fourth embodiment is applicable to the fuel injector of any of the preceding embodiments. In the example shown in FIG. 11, the fourth embodiment is applied to the third embodiment.

The fuel injector according to the fourth embodiment includes a valve seat member 41C in addition to a nozzle member 9C; and the forward end of a valve element 6C is formed in a shape different from that of the third embodiment. Nozzle member 9C of the fourth embodiment includes no valve seat.

The valve seat member 41C is annular and fixed in the downstream end portion of tube member 3. Valve seat member 41C includes upstream and downstream surfaces which are flat and parallel to each other in this example, and a tapered opening extending axially from an upstream end opened in the upstream surface to a downstream end opened in the downstream surface. The tapered opening is tapered to the downstream end, and defined by an inside circumferential wall surface which, in this example, is a conical surface so that the inside diameter becomes smaller toward the downstream end of the tapered hole. A valve seat 41Ca is defined in the inside circumferential wall surface of the tapered opening.

Nozzle member 9C is disposed on the downstream surface of valve seat member 41C so as to close the downstream end of the tapered opening. Nozzle member 9C of this example is in the form of a flat thin plate. Nozzle member 9C is fixed to tube member 3. A plurality of injection holes 9*e* are formed in a center region of nozzle member 9C so as to open into the tapered opening. In this example, the valve seat member 41C and nozzle member 9C constitute a guide section 30C.

The valve portion 7C of valve element 6 of this example has a flat downstream end surface whose circumference is adapted to abut on the valve seat 41Ca. With the flat downstream end, the valve element 6C of this example is simplified in construction.

Figure 12:
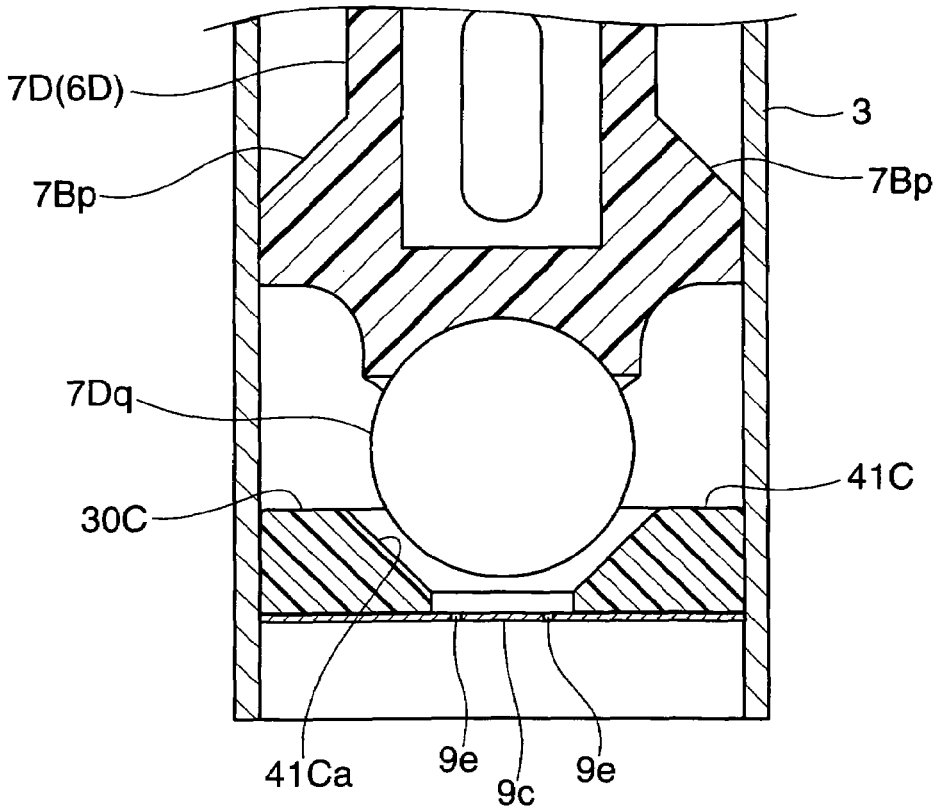
FIG. 12 is an enlarged sectional view showing a downstream end portion of a fuel injector according to a fifth embodiment of the present invention.

A fifth embodiment of the present invention is illustrated in FIG. 12. FIG. 12 is an enlarged sectional view showing a downstream end portion of a fuel injector according to the fifth embodiment. The fuel injector according to the fifth embodiment is almost identical to the fuel injectors according to the preceding embodiments. Accordingly, the same reference numerals are employed for the corresponding parts and repetitive explanation is omitted. The fifth embodiment is applicable to the fuel injector of any of the preceding embodiments. In the example shown in FIG. 12, the fifth embodiment is applied to the fourth embodiment.

In the fifth embodiment, a valve element 6D includes a spherical body or ball 7Dq provided at the lower end of a valve portion 7D unlike the valve element of the fourth embodiment. The plate portions 7Bp are located on the upstream side of the spherical body 7Dq.

In the valve close state, the spherical body 7Dq is seated on the valve seat 41Ca. Preferably, the diameter of spherical body 7Dq is substantially equal to or smaller than the diameter of center cylindrical portion 7Bn of valve portion 7D. The thus-constructed spherical body 7Dq is effective to prevent turbulence of the flow of fuel after passage through passages formed among plate portions 7Bp.

After passage through the fuel passages 7*h* defined by plate portions 7Bp, the fuel flow in the axial direction of tube member 3, at the side of spherical body 7Dq. Therefore, the fuel injector according to the fifth embodiment can change the flow direction from the axial direction to the direction toward the valve seat 9*f* around the spherical body 7Dq, and thereby promote the fuel atomization by promoting the separation of fuel from a wall surface and turbulent flow.

Various variations and modifications of the illustrated embodiments are possible.

The nozzle member 9 (or 9A) may be made of resin material.

This application is based on a prior Japanese Patent Application No. 2005-315172 filed on Oct. 28, 2005; and a prior Japanese Patent Application No. 2006-219631 filed on Aug. 11, 2006. The entire contents of these Japanese Patent Applications No. 2005-315172 and No. 2006-219631 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A fuel injector comprising:

a tube member including an inside bore for passage of a fuel;

a valve seat provided in a downstream end portion of the tube member;

a valve element arranged to slide axially in the tube member to and away from the valve seat;

a plurality of plate portions provided in the valve element and arranged to slide on an inside circumference surface of the tube member, the plate portions projecting radially with respect to an axis of the tube member, each of the plate portions including a side surface extending along the axis of the tube member;

a drive section to move the valve element to and away from the valve seat;

a nozzle member including an injection hole located on an inner side of the valve seat within the tube member and arranged to inject the fuel allowed to pass through a clearance formed between the valve element and the valve seat; and a guide portion to bend the flow of the fuel allowed to flow along the plate portions, toward the axis of the tube member and thereby to guide the fuel to the injection hole.

2. The fuel injector as claimed in claim 1, wherein the nozzle member is a single member formed with both of the injection hole and the valve seat.

3. The fuel injector as claimed in claim 2, wherein the nozzle member includes an inner portion formed with the injection hole; and an outer portion which is formed with the valve seat and which is thicker than the inner portion formed with the injection hole.

4. The fuel injector as claimed in claim 1, wherein the injection hole is tapered.

5. The fuel injector as claimed in claim 1, wherein the valve element includes an end portion shaped in conformity with a shape of the nozzle member.

6. The fuel injector as claimed in claim 1, wherein the valve element is arranged to be centered when the valve element is seated on the valve seat.

7. The fuel injector as claimed in claim 1, wherein the nozzle member includes a domed portion bulging toward the valve element; and the valve seat and the injection hole are both formed in the domed portion.

8. The fuel injector as claimed in claim 1, wherein the valve element is slidably supported at two end portions in the tube member.

9. A fuel injector comprising:

a tube member including an inside bore to receive a fuel;

a valve element arranged to slide axially in the tube member between a valve close position, and a valve open position, the valve element including a center portion; and a plurality of plate portions projecting radially from the center portion, and fitting slidably in the tube member; and a guide section including an outer portion defining a valve seat, and an inner portion which is located on a radial inner side of the outer portion, and which is formed with an injection hole to inject the fuel conveyed through an interspace opened between the valve seat and the valve element, the guide section being arranged to divert the flow of the fuel conveyed along the plate portions, to a radial inward direction toward the injection hole.

10. The fuel injector as claimed in claim 9, wherein the fuel injector further comprises a drive section to move the valve element axially between the valve close position and the valve open position; and the plate portions of the valve element are arranged to guide the fuel conveyed through the inside bore of the tube member, axially toward the guide section located on a downstream side of the valve element.

11. The fuel injector as claimed in claim 9, wherein the guide section comprises a nozzle member including the outer portion and the inner portion which are integral parts of the nozzle member.

12. The fuel injector as claimed in claim 9, wherein the plate portions of the valve element define a plurality of guide grooves extending axially to guide the fuel axially toward the guide section located on a downstream side of the valve element; and the outer portion of the guide section is an annular region surrounding the inner portion formed with the injection hole.

13. The fuel injector as claimed in claim 9, wherein the guide section further comprises a guide portion to bend the flow direction from an axial direction along the plate portions, to the radial inward direction toward the inner portion formed with the injection hole.

14. The fuel injector as claimed in claim 9, wherein the valve element includes a forward end portion; the guide section includes a receiving portion shaped to receive the forward end portion of the valve element and to center the valve element when the valve element is seated on the valve seat.

15. The fuel injector as claimed in claim 14, wherein one of the forward end portion of the valve element and the receiving portion of the guide section includes a depression; the other of the forward end portion of the valve element and the receiving portion of the guide section includes a projection which is shaped to enter the depression and to center the valve element in the valve seat when the valve element is seated on the valve seat.

16. The fuel injector as claimed in claim 9, wherein the nozzle member includes a tubular portion fit in the tube member and an end portion which closes one end of the tubular portion, and which is formed with the valve seat and the injection hole.

17. The fuel injector as claimed in claim 9, wherein the guide section comprises a valve seat member formed with the valve seat and a nozzle member formed with the injection hole.

18. The fuel injector as claimed in claim 9, wherein the valve element includes:

a downstream portion which includes the center portion and the plate portions slidably supported by the tube member;

an intermediate portion defining a fuel chamber around the intermediate portion within the tube member on an upstream side of the downstream portion; and an upstream portion which is slidably supported by the tube member, which is connected with the downstream portion by the intermediate portion, and which is formed with a through hole to allow the fuel in the inside cavity of the tube member to flow through the upstream portion into the fuel chamber.

* * * * *